US006779289B2

(12) United States Patent
Kay

(10) Patent No.: US 6,779,289 B2
(45) Date of Patent: Aug. 24, 2004

(54) FIXED STYLE OF RIFLE BUTTSTOCK FOR CARBINES AND RIFLES

(76) Inventor: Ira Kay, 405 Winchester St., Warrenton, VA (US) 20186

( * ) Notice: Subject to any disclaimer, the term of this patent is extended or adjusted under 35 U.S.C. 154(b) by 0 days.

(21) Appl. No.: 10/066,257

(22) Filed: Jan. 31, 2002

(65) Prior Publication Data

US 2003/0140541 A1 Jul. 31, 2003

(51) Int. Cl.[7] ..... F41A 21/00
(52) U.S. Cl. ..... 42/75.03; 42/72
(58) Field of Search ..... 42/71.01, 72, 73, 42/75.01, 75.03

(56) References Cited

U.S. PATENT DOCUMENTS 3,348,328 A * 10/1967 Roy ..... 42/73
3,618,248 A * 11/1971 Into ..... 42/71.01
3,656,399 A * 4/1972 Hill ..... 89/1.34
3,742,636 A * 7/1973 Dealy et al. ..... 42/111
4,430,822 A * 2/1984 Fromming et al. ..... 42/71.01
4,512,101 A * 4/1985 Waterman, Jr. ..... 42/71.01
5,173,564 A * 12/1992 Hammond, Jr. ..... 42/75.03
5,367,812 A * 11/1994 Lautrec ..... 42/74
5,827,992 A * 10/1998 Harris et al. ..... 89/191.01
5,848,491 A * 12/1998 Biemont ..... 42/85
5,907,918 A 6/1999 Langevin et al. ..... 42/71.01
6,012,246 A * 1/2000 Robinson et al. ..... 42/71.01

* cited by examiner

*Primary Examiner*—Michael J. Carone
*Assistant Examiner*—Troy Chambers
(74) *Attorney, Agent, or Firm*—Shlesinger, Arkwright & Garvey, LLP

(57) ABSTRACT

An M16 or commercial equivalent style rifle buttstock is provided with a stowage compartment within the buttstock body for an M4/M16 style firearm or commercial equivalent that utilizes an adjustable receiver extension which is cylindrical with a radially disposed elongated rib. The buttstock can be inserted without any permanent modifications to the host firearm, and is completely reversible. Internal storage for accessories is provided, and the buttstock is able to accept standard M16 style or commercial buttplates, with or without hinged access doors to the stowage compartment. The buttstock provides an improvement to the ajustable buttstock used on M4/M16 style firearms in cold weather which can become frozen in place in the collapsed position and not provide a proper mounting of the carbine relative to the user. Additionally the buttstock provides all of the standard ergonometric relationships of an M16 style firearm or commercial variant for the user.

6 Claims, 4 Drawing Sheets

FIXED STYLE OF RIFLE BUTTSTOCK FOR CARBINES AND RIFLES

BACKGROUND

1. Field of Invention

This invention relates generally to the field of firearms, and more particularly to a fixed style of buttstock for an M16/M4 style firearm or variant.

2. Description of Prior Art

Heretofore U.S. military rifles and carbines of the M16/M4 style have utilized a rifle receiver extension configuration; or a carbine adjustable position receiver extension of a different configuration.

The lower receiver extension is specifically the attachment point for the buttstock assembly for either the rifle or the carbine.

A rifle extension is cylindrical; and the rifle buttstock of either A1 or A2 military styles has a round tunnel within to allow it to slide over the extension.

A carbine adjustable receiver extension is cylindrical with a longitudinal lug on its inferior surface; a collapsible carbine buttstock has a corresponding tunnel with a keyway to accomodate the lug.

Without intending to be exhaustive of the assigned patents relating to the M16 rifle and M4 carbine and their genre, the following U.S. patents disclose various features which are of importance for understanding the improvements provided by the present invention.

U.S. Pat. No. 3,348,328 to Robert Earl Roy (Oct. 24, 1967) discloses a receiver extension rod for firearms with an elongated rib extending radially outward and a buttstock assembly which can be adjusted in length for individuals of different size. This buttstock does not afford the user of an internal storage cavity, and the normal configuration found on a standard M16/AR15 style buttstock.

U.S. Pat. No. 3,618,248 to Henry A. Into, and John K. Jorczak (Nov. 09, 1971) disclose a buttstock assembly for a firearm with a cylindrical receiver extension of the style found on M16/AR15 rifles, and a buttstock that provides for an internal storage compartment. However, this buttstock configuration cannot slide over the receiver extension disclosed in U.S. Pat. No. 3,348,328, and which is generally used on M4/AR15 style carbines. In this same context, U.S. Pat. No. 4,512,101 to Harold J. Waterman Jr. (Apr. 23, 1985) discloses a buttstock similar to that described in U.S. Pat. No. 3,618,248 with an increase in strength from improved construction cannot slide over the receiver extension disclosed in U.S. Pat. No. 3,348,328.

OBJECTS AND ADVANTAGES

Accordingly, several objects and advantages of my invention are to provide the option of a fixed buttstock for a firearm while utilizing an M4 style or variant of the receiver extension.

Another object of the invention is to modularize the construction of M4/M16 style of rifle and carbines and their variants.

A further object of the invention is to allow for its installation without any permanent modification to the host firearm.

Another object of the invention is to allow the fixed buttstock option and the adjustable buttstock to be substituted for each other whenever desired.

A still further object of the invention is that no machining is required for installation.

Yet another object of the invention is that the fixed buttstock provides the rifle buttstock configuration for the carbine platform without utilizing the rifle receiver extension or buffer system.

Still yet another object of the invention is providing a fixed rifle buttstock for a carbine without requiring the use of a rifle receiver extension.

Another object of the invention is to provide the fixed buttstock conversion for extreme cold weather where the adjustable buttstock may become "frozen" in either an extended or collapsed position, and not function as extensible or collapsible.

A further object of the invention is to provide via the fixed buttstock conversion internal storage for accessories for the carbine.

Yet another object of the invention is that the fixed buttstock provides all the standard dimensions of the rifle for the carbine; effectively creating a "shorter" barreled rifle configuration.

Still further objects and advantages will become apparent from a consideration of the ensuing description and accompanying drawings.

REFERENCE NUMERALS

Figure 1:
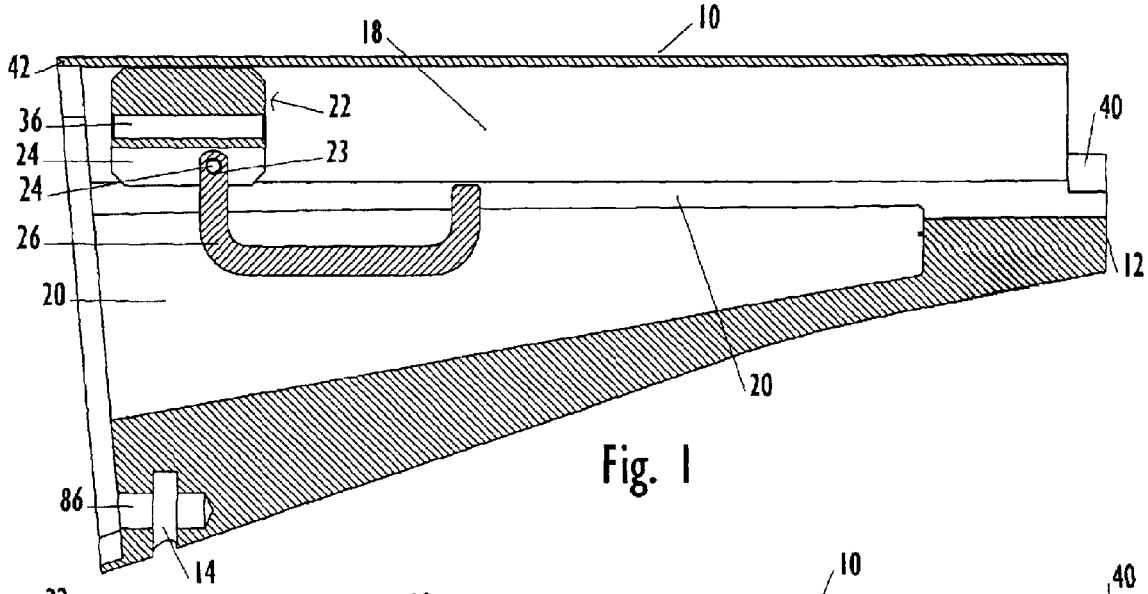
FIG. 1 is a a cross-sectional side view of the buttstock and attachment assembly of the preferred embodiment of the present invention.

10 buttstock body
12 front surface
12A front surface
14 transversely extending slot
16 swivel
18 longitudinal through aperture
20 longitudinal key cut
22 connecting assembly
24 coupling cylinder
26 pivotting retaining arm
28 pivot pin
30 central stowage cavity
32 slot
34 pivot pin bore
36 threaded bore
38 retaining arm pivot pin hole
40 receiver extension locknut counterbore
42 peripheral flange
44 buttstock body recess
46 lower butt plate retaining fastener
48 receiver extension
50 front of receiver extension
52 receiver endplate
54 receiver extension locking nut
56 recess
58 elongated rib
60 butt plate
62 upper butt plate retaining fastener
64 upper butt plate aperture
66 lower butt plate aperture
68 buttstock body
70 bore
72 locating and retaining fastener
74 partial longitudinal bore
76 bulkhead
78 partial longitudinal key cut
80 threaded through bore
82 central cavity for stowage
84 recess in buttstock body
86 lower retaining fastener bore

SUMMARY

A fixed style of buttstock that can insert upon an adjustable receiver extension that is cylindrical with a radially disposed longitudinal lug, or cylindrical receiver extension; and a means of securing it to the firearm. Said buttstock has a stowage cavity that can be used for storing accessories.

Preferred Embodiment—Description

The present invention is a M16 style firearm or commercial variant fixed style buttstock for use with carbines and rifles. In the preferred embodiment, the buttstock is designed as a fixed buttstock for M4/M16 firearms with an adjustable receiver extension which is cylindrical with a longitudinal lug on its lower surface and their commercial equivalents; as well as M16/M4 firearms with a tubular style receiver extension and their commercial equivalents. The object of the present invention in a preferred embodiment is shown in the FIGS. 1–8.

Figure 2:
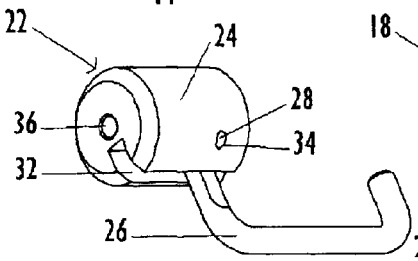
FIG. 2 shows a perspective view of the attachment assembly according to a preferred embodiment of my invention.

Referring to the drawing in greater detail wherein like reference numerals indicate like parts throughout the figures, an assembly incorporating the features of the present invention is shown as being comprised of an elongated buttstock body 10 of M16 family style design with a front surface 12. The buttstock body is molded from a high-impact thermoplastic, such as that sold under the trademark of Zytel. The bottom of the buttstock body 10 is provided with a small transversely extending slot 14 adjacent the back end for receiving a swivel 16 (FIG. 6), which is secured by lower butt plate retaining fastener 46 which passes through lower retaining fastener bore 86 visible in FIGS. 1, 3, 4, and 6. FIGS. 1, 3, 4, and 5 show a longitudinal through aperture 18 which is modified by a longitudinal key cut 20 which together traverse the buttstock body 10 from front to back. As shown in FIG. 1, connecting assembly 22 which is also depicted in FIG. 2 is inserted into the longitudinal through aperture 18 of buttstock body 10. Connecting assembly 22 is comprised of coupling cylinder 24, a pivotting retaining arm 26, and a pivot pin 28 which are shown in FIG. 2. Pivotting retaining arm 26 passes through the longitudinal key cut 20 and into a central stowage cavity 30 as shown in FIG. 1.

FIG. 2 of connecting assembly 22 shows a slot 32 on the bottom surface of coupling cylinder 24. Also depicted is the pivot pin bore 34 through coupling cylinder 24, as well as a threaded bore 36. Pivotting retaining arm 26 is attached to coupling cylinder 24, with a pivot pin 28 which passes through pivot pin bore 34, and through retaining arm pivot pin hole 38, which are shown in FIGS. 1 and 2.

Figure 3:
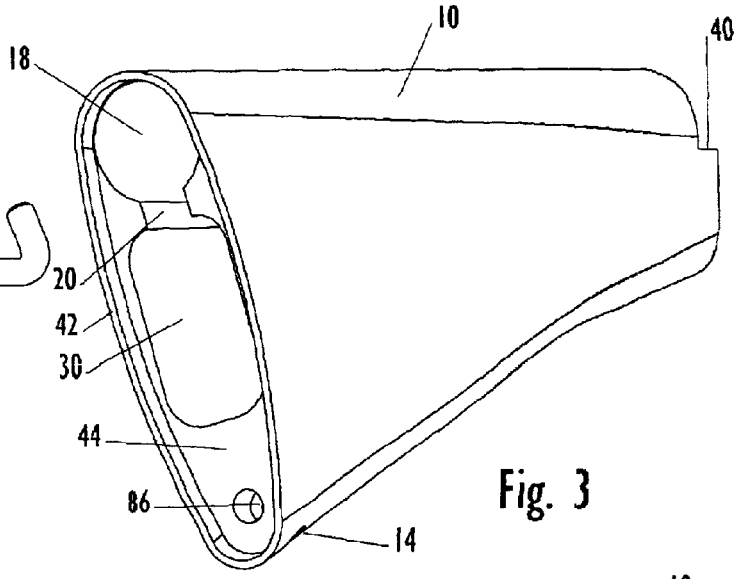
FIG. 3 shows a perspective view of the back end of the buttstock body according to a preferred embodiment of the present invention.
Figure 4:
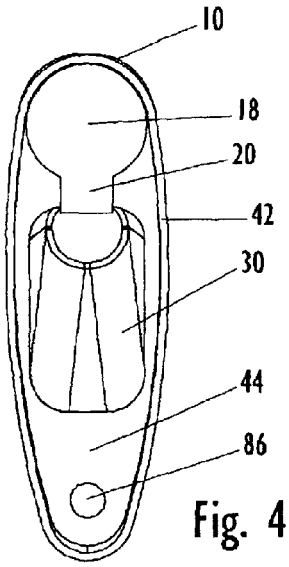
FIG. 4 is a back view of a buttstock body, according to a preferred embodiment of my invention.
Figure 5:
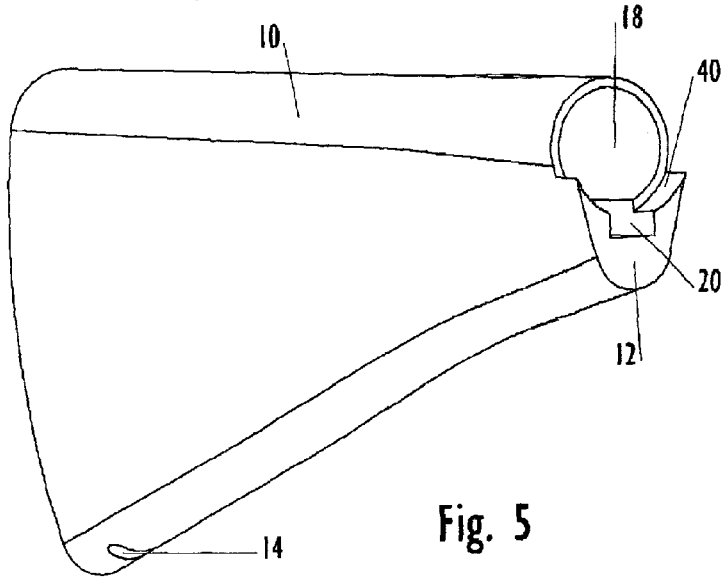
FIG. 5 shows a perspective view of the front end of the buttstock body according to a preferred embodiment of the present invention.

FIGS. 3, 4, and 5 show buttstock body 10, as viewed from a back perspective, back view, and front perspective respectively. Longitudinal through aperture 18, and longitudinal key cut 20 are shown to traverse buttstock body 10 from front to back. FIGS. 1, 3, and 4 show a front surface 12, a receiver extension locknut counterbore 40, and a peripheral flange 42 of buttstock body 10 which outlines a buttstock body recess 44. As shown a central stowage cavity 30 tapers inwardly from its opening at buttstock body recess 44 and terminates within the buttstock adjacent to front surface 12. The lower retaining fastener bore 86 the lower butt plate retaining fastener 46 is shown in these views.

Figure 6:
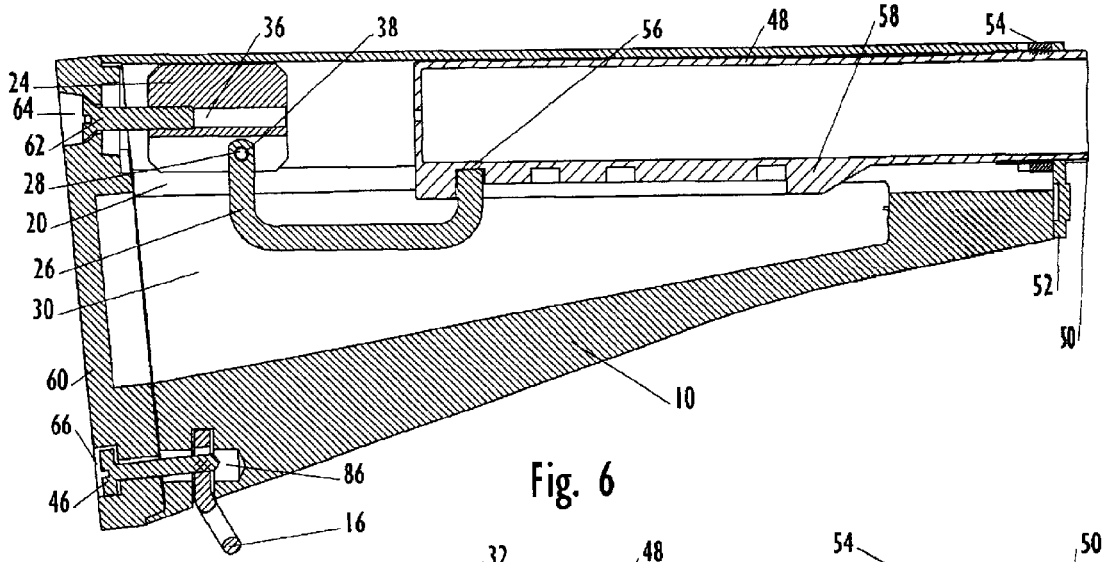
FIG. 6 is a a cross-sectional side view of the buttstock of the preferred embodiment of the present invention assembled to a receiver extension.
Figure 7:
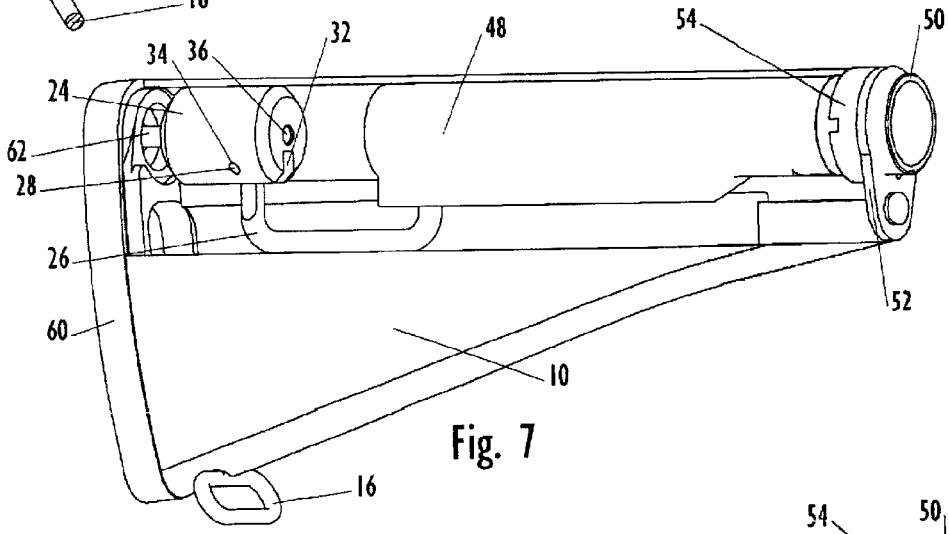
FIG. 7 shows a cutaway view of the buttstock of the preferred embodiment of the present invention assembled to a receiver extension.
Figure 8:
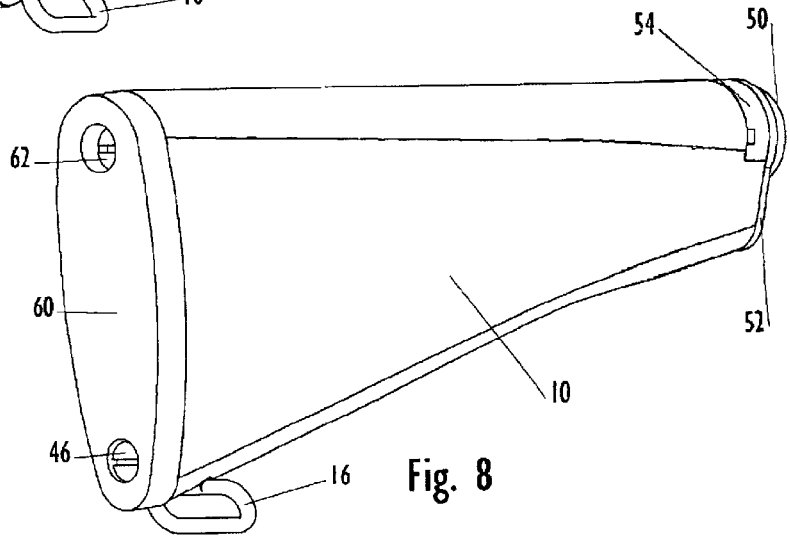
FIG. 8 is a perspective view of the back end of the buttstock of the present invention assembled to a receiver extension.

FIGS. 6 and 7 show the preferred embodiment of the present invention assembled to an M4/M16 or variant adjustable buttstock receiver extension 48 in cross-sectional, and perspective view respectively. Front of receiver extension 50 is threadably inserted within receiver back end (not shown). Receiver endplate 52 approximates the back end of aforementioned receiver. Receiver extension locking nut 54 secures receiver endplate 52 and receiver extension 48 to the back end of aforementioned receiver. Receiver extension 48 is slidably received within longitudinal through aperture 18 and longitudinal key cut 20 of buttstock body 10 with pivotting retaining arm 26 engaging a recess 56 in an elongated rib 58 extending radially outward from the bottom of receiver extension 48. Front surface 12 of buttstock body 10 is shown to be approximating the back surface of receiver endplate 52. FIG. 6 shows butt plate 60 secured to buttstock body 10. Upper butt plate retaining fastener 62 threadably attaches to threaded bore 36 of coupling cylinder 24. Reference should be made to U.S. Pat. No. 3,618,248 for a description of an alternate buttplate of the style commonly employed on M16 style firearms and commercial variants which can be installed in the same manner as butt plate 60 and which would provide a hinged door for access to central stowage cavity 30 when the preferred embodiment of the present invention is installed upon an M4 style firearms or commercial equivalent of receiver extension 48. The butt plate 60 encloses the recessed back end of buttstock body 10 and is held in secure engagement therewith by both lower butt plate retaining fastener 46 which threadably secures to swivel 16 and upper butt plate retaining fastener 62 secured to threaded bore 36 of coupling cylinder 24. FIG. 6 shows upper butt plate aperture 64 and lower butt plate aperture 66 through which upper butt plate retaining fastener 62 and lower butt plate retaining fastener 46 respectively pass through when securing butt plate 60.

Preferred Embodiment—Operation

The preferred embodiment of the present invention provides a buttstock body 10 that is configured with a longitudinal through aperture 18 and a longitudinal key cut 20 that allow it to slide over a receiver extension 48 for a M4 style firearm or commercial variant which has a cylindrical shape with an elongated rib which extends from its inferior surface. The result is the option of a fixed buttstock of M16 style or commercial variant without the necessity of replacing the receiver extension 48. A means for attaching said buttstock body 10 is connecting assembly 22 which holds buttstock body 10 to receiver extension 48 when upper buttplate retaining fastener 62 is tightened.

Installation is accomplished by first sliding buttstock body 10 upon receiver extension 48. Connecting assembly 22 is placed within the longitudinal through aperture 18, and pivotting retaining arm 26 is inserted within receiver extension 48 recess 56. Buttplate 60 or M16 family style equivalent is placed on the back end of buttstock body 10, and fastened to buttstock body 10 and receiver extension 48 with lower buttplate retaining fastener 46 and upper buttplate retaining fastener 62.

The preferred embodiment of the present invention allows the user the ability to utilize an M16 style or commercial variant fixed buttstock without any permanent modifications to the firearm. Buttstock body 10 can additionally be utilized for M16 style firearms and commercial equivalents as well as the M4 style firearms and commercial variants.

Other Embodiments

Fixed Buttstock with Retaining Fastener—Description

Figure 9:
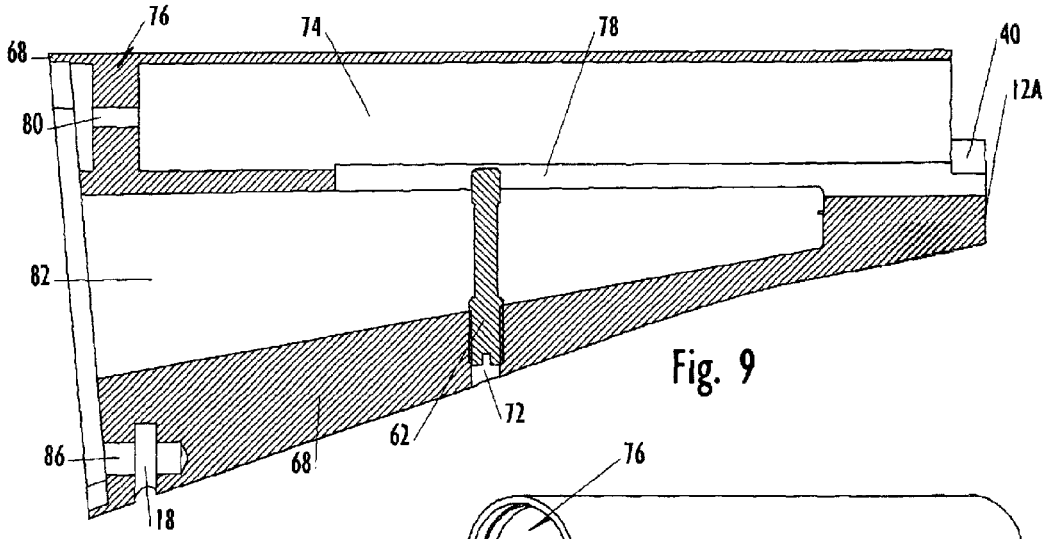
FIG. 9 shows a cross-sectional side view of the buttstock and retaining fastener of an alternative embodiment of my invention.
Figure 10:
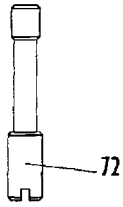
FIG. 10 is a side view of the retaining fastener of an alternative embodiment of my invention.
Figure 11:
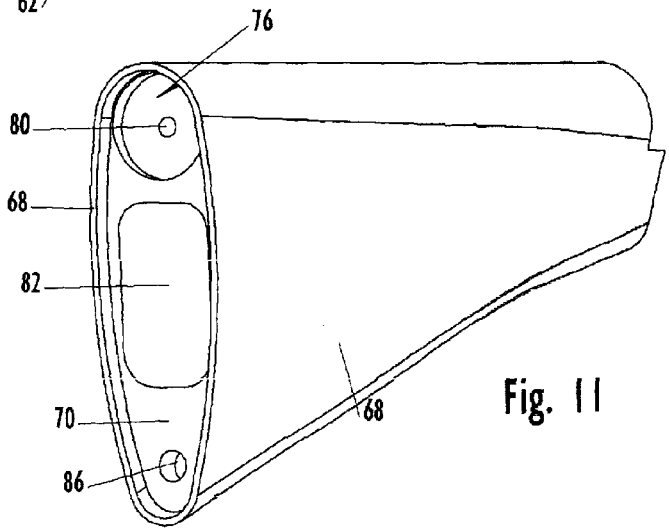
FIG. 11 shows a perspective view of the back end of the buttstock body according to an alternative embodiment of the present invention.
Figure 12:
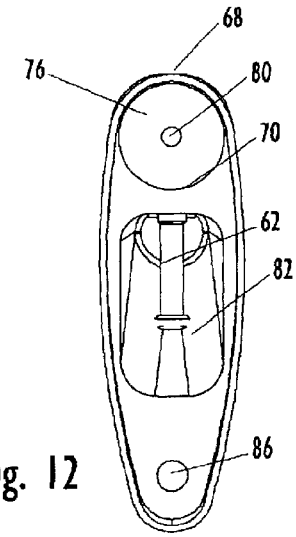
FIG. 12 is a back view of a buttstock body and retaining fastener according to an alternative embodiment of the present invention.
Figure 13:
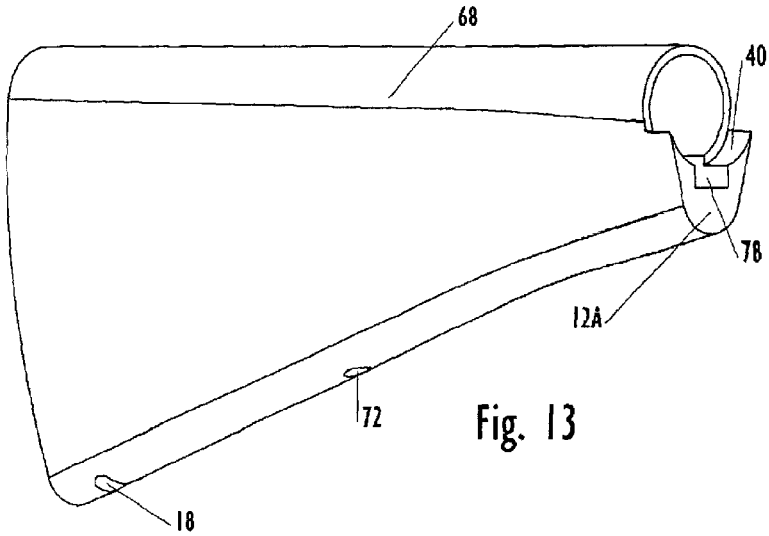
FIG. 13 shows a perspective view of the front end of the buttstock body according to an alternative embodiment of my invention.

Referring now to FIGS. 9–16 wherein are depicted an alternative embodiment of the present invention. FIGS. 9 and 13 shows an elongated M16 style buttstock body 68 viewed in cross-section and front perspective respectively. Visible is front surface 12A. FIGS. 9, 10, 12, and 14 show locating and retaining fastener 72. The bottom of buttstock body 68 is provided with a bore 70 for locating and retaining fastener 72 as shown in FIGS. 9, 13, 14, and 15. As shown in FIG. 9 the top of buttstock body 68 has a partial longitudinal bore 74 which originates at front surface 12A of buttstock body 68 and terminates at a bulkhead 76 formed at the back of the body. A partial longitudinal key cut 78 traverses buttstock body 68 with partial longitudinal bore 74. FIGS. 9–14 show locating and retaining fastener 72 which is threadably inserted within bore 70 of buttstock body 68. FIGS. 9, 11, 12, and 14 show a threaded through bore 80 within bulkhead 76 for insertion of upper buttplate retaining fastener 62. FIGS. 9 and 13 show a receiver extension locknut counterbore 40.

FIGS. 9, 11, and 12 show a central cavity for stowage 82 which tapers inwardly from its opening at a recess in buttstock body 84 and terminates within buttstock body 68 adjacent to front surface 12A, also visible is lower retaining fastener bore 86.

Figure 14:
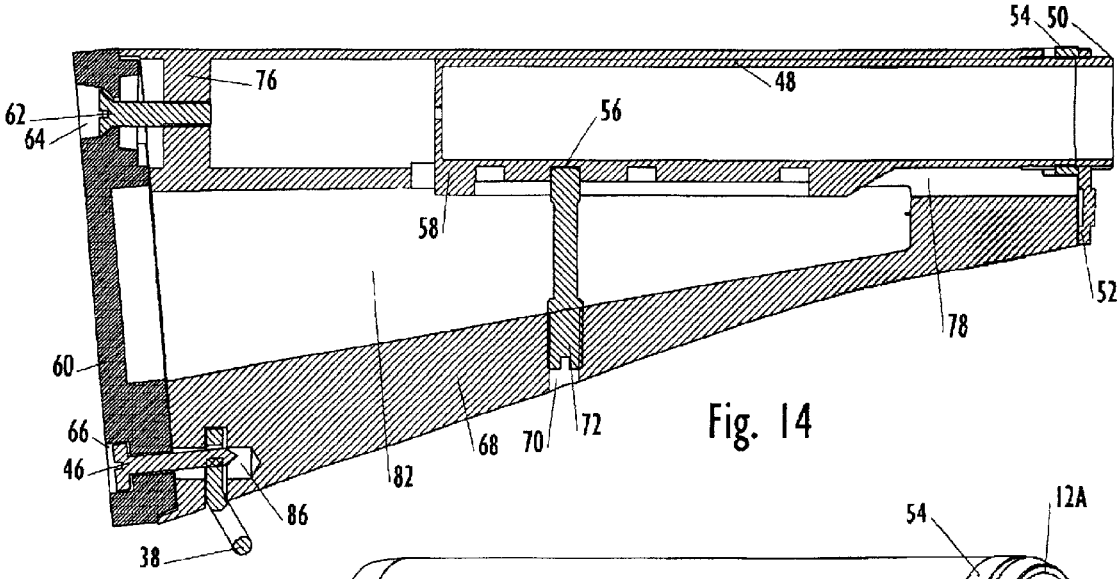
FIG. 14 is a cross-sectional view of the buttstock of an alternative embodiment of the present invention assembled to a receiver extension.
Figure 15:
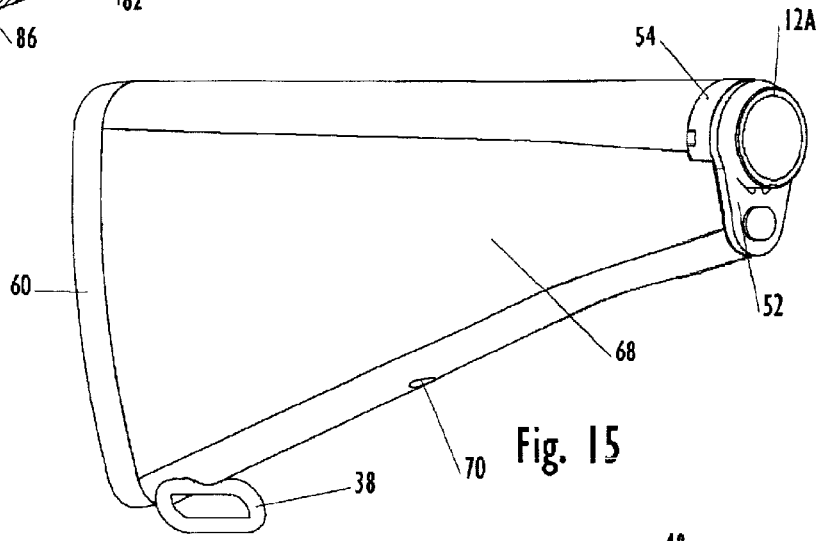
FIG. 15 shows a perspective view of the buttstock of an alternative embodiment of the present invention assembled to a receiver extension.
Figure 16:
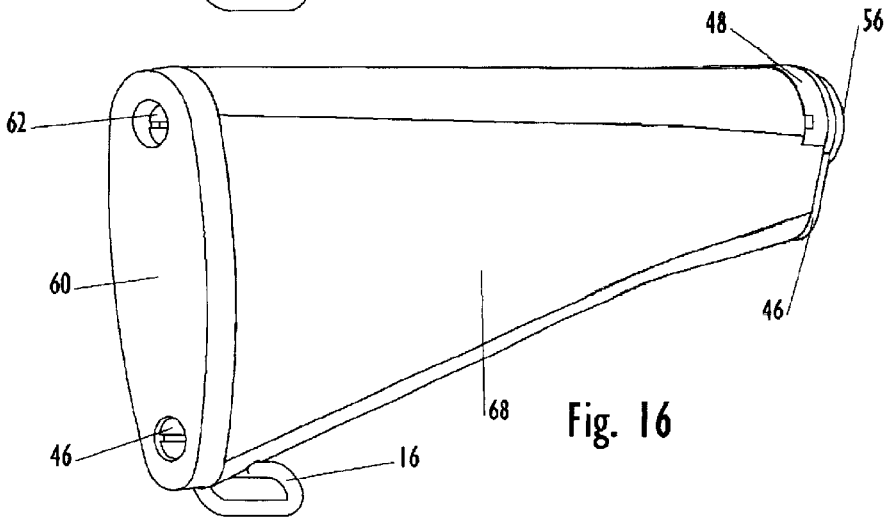
FIG. 16 shows a perspective view of the back end of the buttstock of an alternative embodiment of my invention assembled to a receiver extension.

FIGS. 14–16 show the alternate embodiment of the present invention assembled to a M4/M16 style firearm or a variant therof with a receiver extension 48 in cross-sectional, and perspective views. Front of receiver extension 50 of receiver extension 48 is threadably inserted within receiver back end (not shown). Receiver endplate 52 approximates the back end of aforementioned receiver. Receiver extension locking nut 54 secures receiver endplate 52 and receiver extension 48 to the back of aftorementioned receiver. Receiver extension 48 is slidably receiverd within partial longitudinal bore 74 and partial longitudinal key cut 78 of buttstock body 68 with locating and retaining fastener 72 engaging a recess 56 in an elongated rib 58 extending radially outward from the bottom of receiver extension 48. Front surface 12A of buttstock body 68 is shown to be approximating the back surface of receiver endplate 52. FIG. 14 shows a butt plate 60 secured to buttstock body 68. Upper butt plate retaining fastener 62 threadably attaches to threaded through bore 80 of bulkhead 76 of buttstock body 68. Reference should be made to U.S. Pat. No. 3,618,248 for a description of an alternate buttplate of the style commonly employed on M16 style firearms and commercial variants which can be installed in the same manner as butt plate 60 and which would provide a hinged door for access to central cavity for stowage 82 when the alternate embodiment of the present invention is installed upon and M4 style firearm or commercial equivalent with an equivalent of receiver extension 48. The butt plate 60 encloses the recessed back end of buttstock body 68 and is held in secure engagement therewith by both lower butt plate retaining fastener 46 which threadably secures to swivel 16 and upper butt plate retaining fastener 62 secured to threaded through bore 80 of bulkhead 76 of buttstock body 68. FIG. 14 shows upper butt plate aperture 64 and lower butt plate aperture 66 through which upper butt plate retaining fastener 62 and lower butt plate retaining fastener 46 respectively pass through when securing butt plate 60.

Fixed Buttstock with Retaining Fastener—Operation

The alternate embodiment of the present invention provides a buttstock body 68 that is configured with a partial longitudinal bore 74 and a partial longitudinal key cut 78 that allow it to slide over a receiver extension 48 for a M4 style firearm or variant with a cylindrical receiver extension with an elongated rib that extends radially outward from the inferior surface of the rod. The result is the option of a fixed style buttstock of M16 style or commercial equivalent without the necessity of replacing the receiver extension 48. A means for locating and securing said buttstock body 68 is locating and retaining fastener 72 which is threadably inserted within bore 70 of buttstock body 68 which locates and retains buttstock body 68 to receiver extension 48 when locating and retaining fastener 72 is tightened.

Installation is accomplished by first sliding buttstock body 68 upon receiver extension 48. Locating and retaining fastener 72 is then tightened within bore 70 of buttstock body 68 against a recess 56 of elongated rib 58 of receiver extension 48. Buttplate 60 or M16 style or commercial equivalent is placed on the back end of buttstock body 68, and secured. Retention is accomplished by upper buttplate retaining fastener 62 which threadably inserts within threaded through bore 80 of bulkhead 76, and lower buttplate retaining fastener 46 which inserts through lower retaining fastener bore 86 and threadably inserts within swivel 16.

Conclusions, Ramifications, and Scope

Accordingly, it can be seen that the fixed M16 style or commercial equivalent buttstock of this invention for firearms that utilize an M4/M16 style or commercial equivalent adjustable receiver extensions which are cylindrical with an elongated rib which extend radially outward form its inferior surface affords a great degree of utility and modularity to the manufacture and use of the entire family of M4/M16 carbines and rifles, and their commercial equivalents.

Furthermore the fixed M16 or commercial equivalent style buttstock of this invention has the additional advantages in that:

It can be readily installed without any permanent modifications to the M4/M16 or commercial equivalent style of carbine or rifles or shotguns;

it allows a firearm configuration that can be readily and reversibly reconfigured between an adjustable and a fixed buttstock with internal storage capability; and it provides a fixed buttstock conversion for M4/M16 style or commercial equivalent firearms for cold weather use where adjustable buttstocks can freeze in place and become inoperable.

Although the description above contains many specifities, these should not be construed as limiting the scope of the invention but as merely providing illustrations of some of the presently preferred embodiments of this invention. Various other embodiments and ramnifications are possible within it's scope. For example:

The fixed buttstock can be made in various lengths to accomodate users of different size;

the fixed buttstock can be made with a foam liner to minimize harmonic vibration when the firearm is fired; and the fixed buttstock can be located and secured to the M4/M16 or commercial style of receiver extension utilizing a locating pin that is kept in an extended position against one of the recesses within the elongated rib of the receiver extension by pressure from a compression spring.

It will be apparent to those skilled in the art that many modifications and substitutions can be made to the preferred embodiment without departing from the spirit and scope of the invention.

Thus the scope of the invention should be determined by the appended claims and their legal equivalents, rather than by the examples given.

What is claimed is:

1. A fixed style buttstock for a firearm having a receiver extension with an elongated rib extending radially outwardly, said rib having a recess, comprising:

a) a buttstock body having a stowage cavity, a longitudinal through aperture to receive said extension, and a longitudinal key cut to receive said rib;

b) a coupling body receivable within said aperture, said coupling body having a threaded hole;

c) a retaining arm with one end portion pivotally connected to said coupling body;

d) said retaining arm including another end portion receivable within said recess;

e) a butt plate for covering said stowage cavity, said butt plate including an opening aligned with said threaded hole; and f) a fastener receivable within said opening and said threaded hole to hold said butt plate against said buttstock body to pull said coupling body toward said butt plate, thereby securing said another end portion within said recess to secure said buttstock body to said extension.

2. A fixed style buttstock as in claim 1, wherein said aperture is cylindrical.

3. A fixed style buttstock as in claim 1, wherein said coupling body is cylindrical.

4. A fixed style buttstock as in claim 1, wherein said retaining pin is U-shaped.

5. A fixed style buttstock as in claim 1, wherein said stowage cavity communicates with aperture.

6. A fixed style buttstock as in claim 1, wherein:

a) said coupling body includes a slot; and b) said one end portion is disposed within said slot.

* * * * *